United States Patent [19]

Brodalla et al.

[11] Patent Number: 4,992,155

[45] Date of Patent: Feb. 12, 1991

[54] CIRCUITRY FOR THE ELECTROLYTIC COLORING OF ANODIZED ALUMINUM SURFACES

[75] Inventors: Dieter Brodalla, Duesseldorf; Werner Huppertz, Krefeld; Georg Wagner, Chieming, all of Fed. Rep. of Germany; James W. Costello, Sellersville, Pa.; Karl-Heinz Munk, Hamm, Fed. Rep. of Germany

[73] Assignee: Henkel Kommanditgesellschaft auf Aktien, Duesseldorf, Fed. Rep. of Germany

[21] Appl. No.: 463,180

[22] Filed: Jan. 10, 1990

Related U.S. Application Data

[60] Division of Ser. No. 363,316, Jun. 5, 1989, Pat. No. 4,915,801, which is a continuation of Ser. No. 76,647, Jul. 23, 1987, abandoned.

[30] Foreign Application Priority Data

Jul. 23, 1986 [DE] Fed. Rep. of Germany ..... 3624868
Jun. 4, 1987 [DE] Fed. Rep. of Germany ..... 3718741

[51] Int. Cl.[5] ..... C25D 11/22; C25D 17/00

[52] U.S. Cl. ..... 204/228; 204/211; 204/DIG. 9

[58] Field of Search ..... 204/228, 211, 42, 37.6, 204/DIG. 9

[56] References Cited

U.S. PATENT DOCUMENTS 3,669,856 6/1972 Gedde ..... 204/58
3,704,209 11/1972 Patrie ..... 204/37.6
3,915,813 10/1975 Abe et al. ..... 204/37.6
4,011,152 3/1977 Rodriquez-Martinez ..... 204/228
4,316,780 2/1982 Yoshida et al. ..... 204/37.6
4,338,176 7/1982 Garcia Pelaez ..... 204/228
4,421,610 12/1983 Rodriguez ..... 204/37.6

FOREIGN PATENT DOCUMENTS 870174 5/1971 Canada .
1257047 12/1971 United Kingdom .
2034083 5/1980 United Kingdom .

*Primary Examiner*—John F. Niebling
*Assistant Examiner*—William T. Leader
*Attorney, Agent, or Firm*—Ernest G. Szoke; Wayne C. Jaeschke; Real J. Grandmaison

[57] ABSTRACT

A process and circuitry for the electrolytic coloring of an anodized article of aluminum or aluminum alloy in a coloring bath containing at least one metal salt for coloring the article. The process comprises applying to the coloring bath a controllable, asymmetrical and substantially sinusoidal a.c. voltage of substantially constant frequency. The sinusoidal a.c. voltage is obtained from a voltage source supplying a symmetrical sinusoidal a.c. voltage and at least one of the two current paths is divided into two parallel main lines and fed to electrical components whereby the amplitude level of the positive half wave and the amplitude level of the negative half wave and the ratio of the amplitude level of the positive half wave to the amplitude level of the negative half wave of the a.c. voltage applied to the coloring bath are made variable and adjustable independently of one another, adjusting the positive half wave and the negative half wave to the desired values, and recombining the main lines to form the a.c. voltage applied to the coloring bath.

5 Claims, 3 Drawing Sheets

CIRCUITRY FOR THE ELECTROLYTIC COLORING OF ANODIZED ALUMINUM SURFACES

This application is a division of application Ser. No. 07/363,316, filed 06/05/89 now U.S. Pat. No. 4,915,801, which is a continuation of application Ser. No. 07/076,647 filed on 07/23/87 now abandoned.

BACKGROUND OF THE INVENTION

1. Field of the Invention

This invention relates to a process and circuitry for the electrolytic coloring of anodized articles of aluminum or aluminum alloy in a coloring bath which contains at least one metal salt coloring the aluminum article by using an asymmetrical, substantially sinusoidal a.c. voltage consisting of two separately controllable half-wave trends obtained by corresponding rectification.

2. Discussion of Related Art

Articles of aluminum or aluminum alloys are often used as visible elements in the construction field and in architecture. For example, aluminum is frequently used for facade panels of buildings. In such applications, the panels must be provided with a protective coating and must also lend themselves to coloring.

Thus, German Published Application No. 19 02 983 describes a process for the production of a colored protective coating on articles of aluminum or aluminum alloys, in which an alternating current is passed through a coloring bath. In this process, the a.c. voltage applied to the coloring bath is made asymmetrical by modulation, i.e. by superimposing a second voltage thereon. This involves considerable technical demand; in particular, a second voltage source is always necessary. In addition, dark colors are only obtained after a relatively long treatment time and by successive treatment first with a symmetrical and then with an asymmetrical a.c. voltage. Modulation also means that the amplitude or frequency of an oscillation changes with time, so that a sinusoidal a.c. voltage of constant frequency is not readily obtained.

Both here and in the following, the term "asymmetrical" is applied to an a.c. voltage or an a.c. current when, although its trend as a function of time is periodic irrespective of shape, the half waves of one direction differ form the half waves of the other direction in their trend and their mean intensity value.

European Patent No. 0 056 478 describes a process in which th aluminum parts to be colored are treated first with alternating current in one bath containing no coloring metal salts, and then with an a.c. voltage in a second bath containing metal salts which color the aluminum parts. The disadvantage of this process lies in the use of two baths for coloring, in the very high technical demand involved, and in the magnitude of the voltage used (55 to 85 volts). In addition, relatively long coloring times are also required to obtain dark colors.

German Published application No. 1,930,288 and U.S. Pat. No. 3,669,856 describe a process and circuitry for coloring aluminum alloys by application of an asymmetrical a.c. voltage or a combination of symmetrical and asymmetrical a.c. voltage. In said process, an asymmetrical a.c. voltage applied to the coloring bath, wherein the positive and negative half waves are separately controllable, is produced on the secondary side of a transformer by the division of a current feed path to the coloring bath into two parallel branches each comprising a rectifier directed oppositely to the other and a variable resistor connected in series with the rectifier, or an individually variable voltage controlled rectifier, more especially a thyristor, directed oppositely to the other. These two branches are recombined into a single path prior to the coloring bath. This prior art is attended by the disadvantage that the current path is only divided on the secondary side of the transformer and the current or voltage trend on the secondary side is controlled by resistors or thyristors. However, where a resistance-controlled current source such as this is constructed on an industrial scale, considerable energy outlay is involved in cooling the variable resistors because they heat up enormously. At 10,000 A, the power dissipation occuring amounts to around 50–100 kW. In addition, the use of variable resistors on the secondary side is attended by the disadvantage that, due to the high voltage-dependent load alternation behavior of the coloring bath, the voltage undergoes deformation so that the voltage trend in the coloring bath is no longer sinusoidal. Since a coloring bath is characterized by an alinear current-voltage curve, this also affects the voltage drop across a series-connected resistance so that a voltage which has a sinusoidal trend before a resistance no longer has that sinusoidal trend after the resistance and hence parallel to the coloring bath. Neither can a sinusoidal voltage trend be maintained in the coloring bath by control with thyristors.

An object of the present invention is to provide a solution to the aforementioned disadvantages which speeds up the coloring process while guaranteeing uniform coloring and which may be implemented on an industrial scale with simple technical means and which enables an asymmetrical, substantially sinusoidal a.c. voltage with separately controllable positive and negative half waves to be applied to the coloring baths and to be maintained.

DESCRIPTION OF THE INVENTION

Other than in the operating examples, or where otherwise indicated, all numbers expressing quantities of ingredients or reaction conditions used herein are to be understood as modified in all instances by the term "about ".

In accordance with this invention, a controllable, asymmetrical and substantially sinusoidal a.c. voltage of substantially constant frequency is applied to a coloring bath, being produced by the division of at least one of two current paths which emanate from a voltage source supplying a symmetrical sinusoidal a.c. voltage and which end in the coloring bath, into two lines wherein the a.c. voltage taken from the voltage source is fed to electrical components, more especially variable transformers and directional static converter valves or a diode and/or thyristor brige, by means of which the amplitude level of the positive and negative half waves and the ratio of the amplitude level of the positive half wave to the amplitude level of the negative half wave of the a.c. voltage applied to the coloring bath are made variable and adjustable independently of one another, adjusted to the desired values and recombined to form the a.c. voltage applied to the coloring bath by combination of the seperate lines and introduction of the current paths into the coloring bath.

The invention provides for a much shorter coloring time as compared to prior art processes while maintaining a depth scatter of sufficient intensity for use in industrial coloring baths. The depth scatter is assured by the alternating current applied and may be adjusted as required by varying the amplitude levels of the positive and negative half waves of the sinusoidal a.c. voltage having a substantially constant frequency. By virtue of the fact that the amplitude levels of the positive and negative half waves of the a.c. voltage are made variable independently of one another in the electrical components, it is possible to influence the desired coloring of the aluminum article and also the depth scatter as required by corresponding regulation of the positive or negative half wave of the always substantially sinusoidal a.c. voltage.

The coloring times for the aluminum article are considerably shortened by the process according to the invention. For example, a dark brown color may be obtained in a coloring time of only 2 minutes, while an anthracite color may be obtained after a coloring time of 4 minutes. In addition, it is another advantage, particularly for industrial application, that different colors may be obtained in the same coloring bath for the same coloring time by corresponding variation of the amplitiude levels of the positive and negative half waves in relation to one another.

Further, the voltages applied in the process according to the invention are relatively low so that the process may be carried out inexpensively using simple apparatus.

In one particularly advantageous embodiment of the invention, an a.c. voltage of from 9 to 30 volts and a current density of from 0.2 to 1.2 $A/dm^2$ is applied to the coloring bath during the coloring process, wherein the amplitude level of the negative half wave is greater than that of the positive half wave and the value for the negative peak voltage is more negative than −9 volt.

In another embodiment of the invention, the coloring time is preferably kept substantially constant and the different colors which the aluminum article can be given through the coloring bath are produced solely by adjusting the amplitude levels of the positive and negative half waves.

In another advantageous embodiment of the invention, the asymmetrical a.c. voltage is applied to the coloring bath after a non-coloring, direct-current pretreatment is carried out in the same coloring bath. In this way, particularly uniform coloring of the aluminum article may be obtained. It is particularly convenient in this regard to carry out the direct current pretreatment using a rectifier circuit which produces a current having a residual ripple factor of 120%, preferably 50% and, more preferably, 5% for loads loads with purely ohmic resistance behavior and a resulting residual ripple factor of preferably less than 15%.

In another embodiment of the invention, the direct current and/or alternating current treatment is carried out in a coloring bath containing only one metal salt.

The invention may be practiced with relatively simple apparatus if the two current paths starting out from the voltage source are divided into two main lines which are each successively fed therein first to a first variable transformer, then to a second transformer and, finally, to directional static converter valves, more especially a so-called one-way circuit with decoupling diodes, after which the current paths are recombined and fed as an a.c. voltage source to the coloring bath, wherein the transformers and static converter valves are arranged in parallel and correspond to one another in the two main lines having the same electrotechnical characteristics, as proposed in another embodiment of the invention. The use of the variable transformers eliminates the deviation from the sinusoidal trend of the coloring voltage which is known from resistance-controlled current sources, because the internal resistance of the transformers is very low and cannot be changed even by manipulative control.

To achieve the afore-mentioned object, the invention provides a circuit arrangement characterized by an a.c. voltage source, the division of the two current paths emanating therefrom into two parallel lines; having arranged therein and each corresponding to the other in its characteristics, variable-ratio transformers, main transformers and directional static converter valves, more especially diodes, oriented oppositely to one another in the current path of the particular line, and recombination of the two parallel lines of form an a.c. voltage source.

In another embodiment, the invention provides a circuit arrangement which is characterized by an asymmetrical diode and/or thyristor bridge connected in series with a d.c. voltage source in a current path extending from an a.c. voltage source and which comprises a different number of diodes and/or thyristors in its branches permeable to the positive or negative half wave.

The process according to the invention may be advantageously carried out with both circuit arrangements according to the invention . The circuit arrangements enable the amplitude levels of the positive and negative half waves of an a.c. voltage to be adjusted and regulated separately from and independently of one another, although the generally sinusoidal curve of the a.c. voltage is substantially maintained. In this way, the ratio of the amplitude level of the positive half wave to the amplitude level of the negative half wave may be influenced by adjustment of the positive half wave without altering the negative half wave adjusted or by adjustment of the negative half wave without altering the positive half wave adjusted or by adjustment of both half waves. The current density may of course also be influenced in this manner. However, what is important, and this is again expressly emphasized here, is that the sinusoidal trend is largely maintained in the circuit arrangements according to the invention. Neither modulations, i.e. amplitudes or frequencies changing rhythmically with time, nor special voltage trends such as for example, sawtooth or square-wave trends or even interrupted trends, occur at the a.c. voltage applied in the coloring bath where the process and the circuit arrangements according to the invention are used. The sinusoidal trend of the a.c. voltage is maintained in the coloring bath throughout the coloring process.

BRIEF DESCRIPTION OF THE DRAWINGS

The invention is described in more detail in the following with reference to the accompanying drawings, wherein.

DETAILED DESCRIPTION OF THE DRAWINGS

Figure 1:
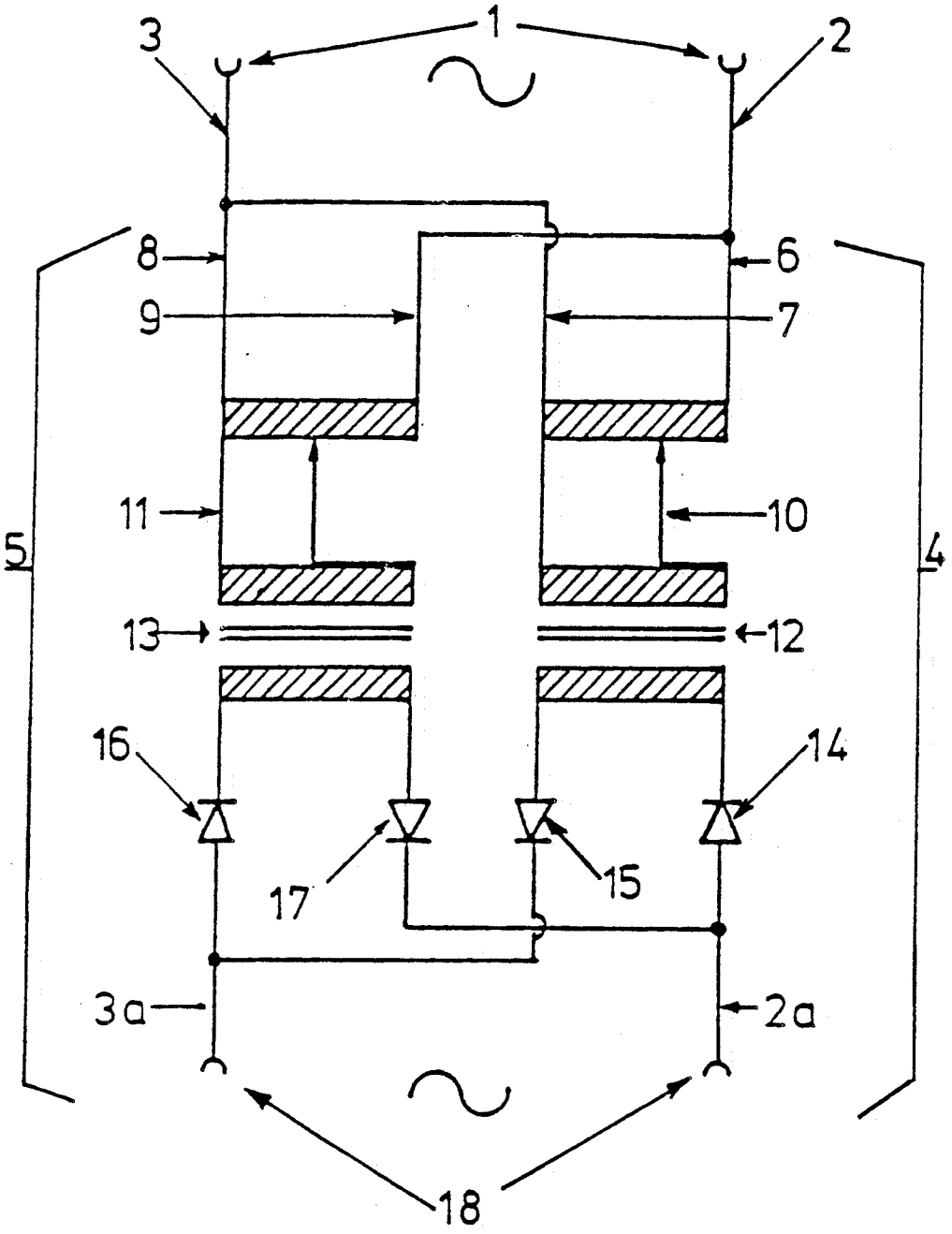
FIG. 1 diagrammatically illustrates the circuitry according to one embodiment of the invention.

As shown in FIG. 1, from an a.c. voltage source 1 which supplies a voltage potential of 220 volts, 380 volts or 415 volts for example, the current paths 2 and 3 leads to a junction where they are divided up into two parallel lines 4 and 5 consisting of individual current paths 6, 7 and 8 and 9. In these two parallel lines, the current paths are fed to variable-ratio transformers 10 and 11, to main transformers 12 and 13 and then to diodes 14, 15 and 16, 17 arranged in opposite directions to one another in the current path of the particular line. The diodes 14 to 17 form a so-called one-way circuit with decoupling diodes. The two parallel lines 4 and 5 are then recombined at junctions into two current paths 2*a* and 3*a*. The two current paths 2*a* and 3*a* then form the voltage source 18 for the electrolytic coloring bath. The electrical components 10 and 11, 12 and 13 and 14, 15 and 16, 17 arranged in the lines 4 and 5 and associable with one another have the same electircal characteristics; in particular, the direction in which the variable-ratio transformers 10, 11 and the main transformers 12, 13 are wound must be the same in either case.

An a.c. voltage having a frequency of from 40 to 70 c/s is taken from the voltage source 1. An a.c. voltage of from 10 to 30 volts and a current density of from 0.2 to 1.2 A/dm$^2$, as measured with a moving-iron instrument, are fed to the coloring bath.

Figure 2:
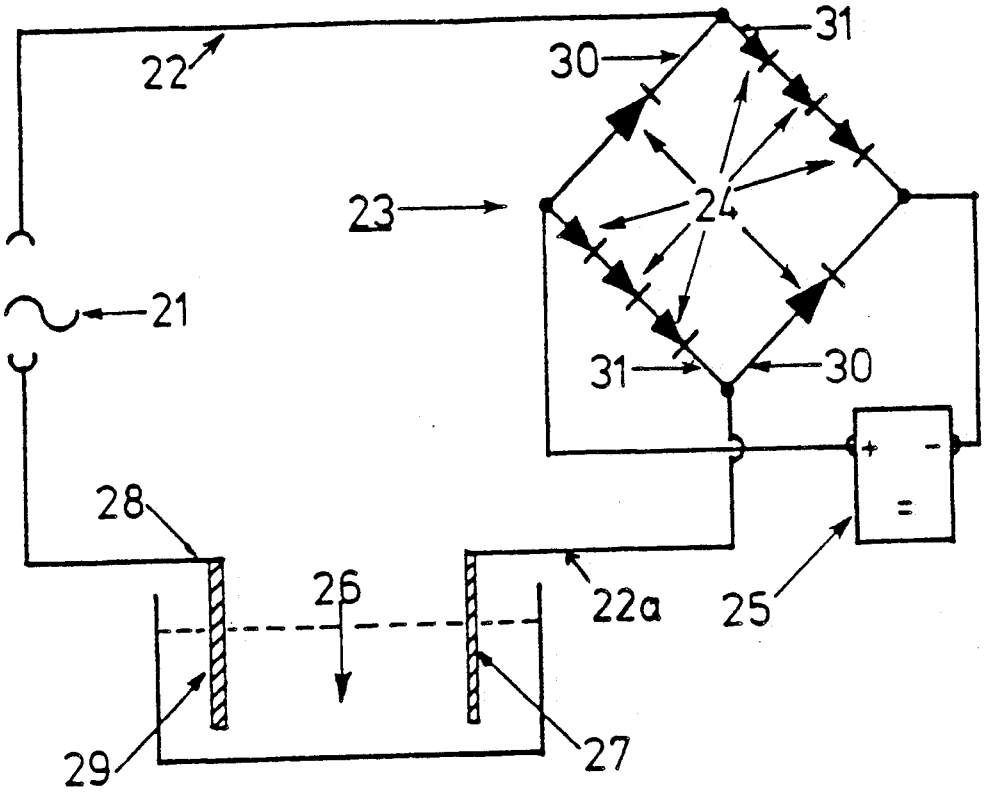
FIG. 2 diagrammatically illustrates the circuitry according to another embodiment of the invention.

FIG. 2 illustrates a slightly different circuit arrangement in accordance with this invention. In this embodiment, an asymmetrical diode bridge 23 is arranged in a current path 22 extending from an a.c. voltage source 21. The diode bridge 23 is formed from a plurality of diodes 24 of the same type wherein three series-connected diodes 24 are arranged in the branches 31 permeable to the positive half wave of the alternating current, with one diode in each of the branches 30 permeable to the negative half wave of the alternating current. A d.c. voltage source 25 is connected in series with the diode bridge 23 in such a way that each half wave of the a.c. voltage is connected in series with the d.c. voltage source.

Figure 3:
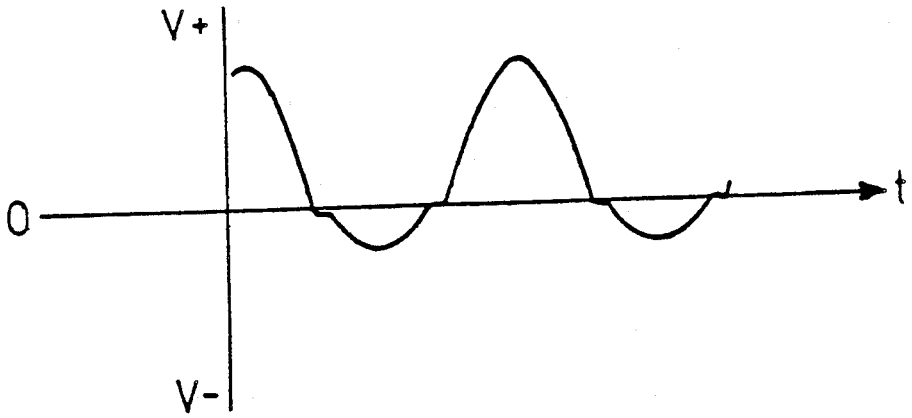
FIGS. 3 and 4 depict voltage curve trends obtainable with the circuitry of FIG.1.
Figure 4:
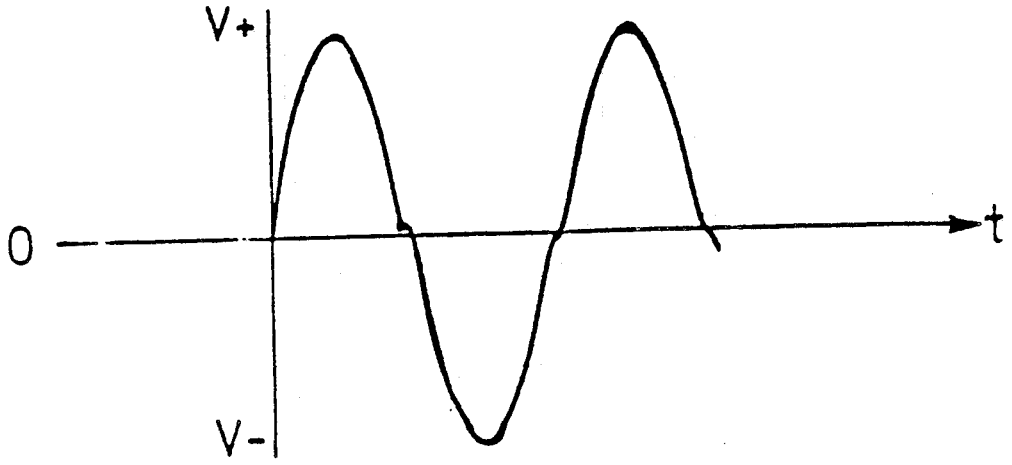

The diode bridge 23 is connected to the aluminum part 27 in the coloring bath 26 by a current path 22*a*. A counter electrode 29 in the coloring bath 26 is connected to the a.c. voltage source 21 by a current path 28. In this embodiment, the coloring bath 26 contains only one coloring metal salt. According to Example I, this salt is tin sulfate . FIGS. 3 and 4 show possible voltage curve trends obtainable with the circuit arrangement shown in FIG. 1, the short horizontal curves at the transition from negative to positive half wave being caused by the diode threshold voltage of the particular diode used.

Figure 5:
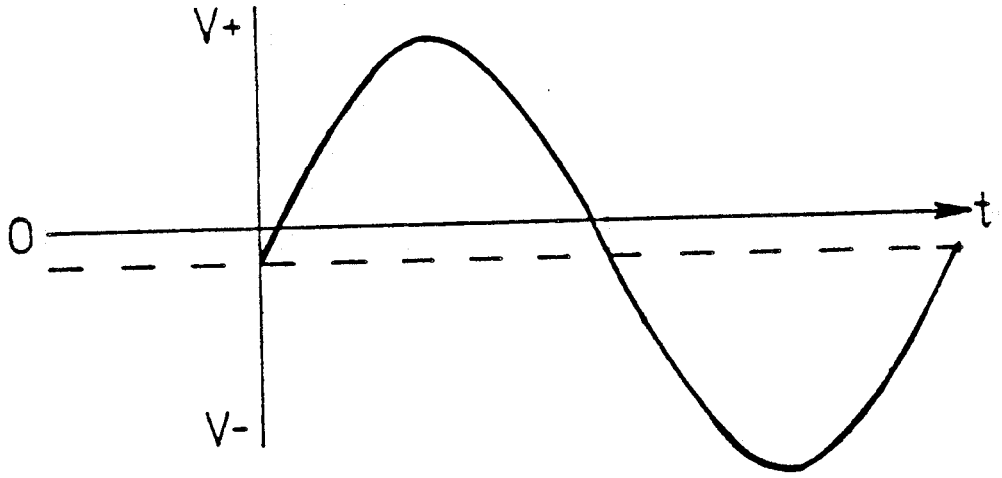
FIG. 5 depicts a voltage curve trend obtainable with the circuitry of FIG. 2.

FIG. 5 shows an example of a voltage curve trend obtainable with the circuit arrangement shown in FIG. 2. In FIGS. 3, 4 and 5, V stands for voltage, t for time and 0 for neutral position. The voltage curve trend shown in FIG. 5 is obtained , for example, by adjusting the d.c. voltage source 25 in such a way that a small bridge current just flows, resulting in direct superimposition of the d.c. voltage issuing from the voltage source 25 without the switching thresholds of the diodes 24 distorting the sinusoidal a.c. voltage. With this circuit arrangement, the superimposed voltage may be adjusted stepwise corresponding to the diode threshold voltage, for example in increments of 0.3 volt in the case of germanium and 0.6 volt in the case of silicon. Several coloring examples using a circuit arrangement of the type shown in FIG. 2 are presented in the following:

EXAMPLE I

Pre-anodized aluminum parts where treated with various superimposed voltages over a constant period of 4 minutes in a coloring bath containing 20 g/l tin sulfate, 24 g/l sulfuric acid and a stabilizer. The effective value of the a.c. voltage was 10 volts. The following coloring results were obtained:

| Superimposed voltage | Color |
|---|---|
| −0.4 volt | light bronze |
| −0.8 volt | light bronze |
| −1.2 volt | dark brown |
| −1.8 volt | anthracite |

EXAMPLE II

Pre-anodized aluminum parts were treated as in Example I, but with an effective value of the a.c. voltage of 16 volts and a treatment time of 2 minutes. The following coloring results were obtained:

| Superimposed voltage | Color |
|---|---|
| +1.8 volt | light bronze |
| 0.0 volt | medium bronze |
| −0.8 volt | dark brown |

In this example, the aluminum parts were first anodized in the usual way, i.e. in a sulfuric acid bath with a concentration of 150 to 250 g/l; voltage 12 and 18 volts; treatment time 15 to 60 minutes; current density 1 to 2 A/dm$^2$.

The process according to the invention and the circuitry for carrying it out may be sued both in so-called single-stage coloring processes, i.e. the current/voltage trend and/or the coloring bath remains substantially unchanged throughout the coloring process; and also in so-called multistage coloring processes, i.e. where the current/voltage trend and/or the coloring bath are change at least once during the coloring process.

Thus, it is of course also possible only to feed the a.c. voltage according to the invention to the coloring bath after the aluminum parts have been treated with d.c. current in the coloring bath. In general, this is followed by the actual coloring of the aluminum part, but only by application of an a.c. voltage.

The diodes shown in FIG. 1 do not necessarily have to be oppositely directed in pairs. It is also possible, for example to provide a diode in only one of the corresponding current paths of each line and to arrange the remaining diodes in directions opposite to one another. For example, the diodes 15 and 17 may be left out and only the oppositely arranged diodes 14 and 16 installed as shown in FIG. 1. It is also possible, if necessary, to provide more than one series-connected diode in each path of the lines.

Thyristors may of course also be used instead of diodes. The direct current pretreatment is carried out using a rectifier circuit which, for loads with purely ohmic resistance behavior, produces a residual ripple factor of 120% in the case of a one-way circuit, 50% in the case of a two-way circuit and 5% in the case of a three-phase bridge circuit. Since, in practice, the capacitance of the coloring bath acts as a capacitor, full-wave rectification result in a residual ripple factor of around 15%.

I claim:

1. A circuit arrangement adapted to provide an a.c. voltage having a negative half wave and a positive half wave for the electrolytic coloring of an anodized article of aluminum or aluminum alloy in a coloring bath which contains at least one metal salt for coloring said article, comprising a voltage source supplying a symmetrical, sinusoidal a.c. voltage having two current paths, said current paths being divided into two parallel main lines each consisting of a pair of individual current paths, each pair of said individual current paths being successively fed to a variable ratio transformer, then to a second transformer, and then to a diode or thyristor, said main lines being recombined to form the a.c. voltage applied to said coloring bath by combining the pairs of individual current paths, whereby the amplitude level of the positive half wave and the amplitude level of the negative half wave and the ratio of the amplitude level of the positive half wave to the amplitude level of the negative half wave of the a.c. voltage are made variable and adjustable independently of one another to provide a controllable, asymmetrical and substantially sinusoidal a.c. voltage of substantially constant frequency.

2. A circuit arrangement as in claim 1 wherein each individual current path includes a diode or thyristor.

3. A circuit arrangement as in claim 1 adapted to provide an a.c. voltage to said coloring bath of from about 10 to about 30 volts with a current density of from about 0.2 to about 1.2 $A/dm^2$.

4. A circuit arrangement as in claim 3 adapted to provide an amplitude level of said negative half wave greater than that of said positive half wave and a value for the negative peak voltage more negative than about −9 volt.

5. A circuit arrangement as in claim 1 wherein said variable ratio transformer, said second transformer, and said diode or thyristor in each of the two parallel main lines have the same electrical characteristics.

* * * * *